US007762414B2

(12) United States Patent
Uytterhaeghe et al.

(10) Patent No.: US 7,762,414 B2
(45) Date of Patent: Jul. 27, 2010

(54) CLOSURE DEVICE FOR A FLUID PRODUCT RESERVOIR

(75) Inventors: Luc Uytterhaeghe, Varredes (FR); Frédéric Berthelin, Meaux (FR); Jean-Marc Philbois, Marne (FR)

(73) Assignee: Seaquist General Plastics, Poincy (FR)

( * ) Notice: Subject to any disclaimer, the term of this patent is extended or adjusted under 35 U.S.C. 154(b) by 1051 days.

(21) Appl. No.: 10/549,501

(22) PCT Filed: Mar. 11, 2004

(86) PCT No.: PCT/FR2004/000581

§ 371 (c)(1),
(2), (4) Date: Jul. 10, 2006

(87) PCT Pub. No.: WO2004/083044

PCT Pub. Date: Sep. 30, 2004

(65) Prior Publication Data

US 2007/0012644 A1 Jan. 18, 2007

(30) Foreign Application Priority Data

Mar. 14, 2003 (FR) ..... 03 03144

(51) Int. Cl.
*B65D 41/00* (2006.01)

(52) U.S. Cl. ..... 215/253; 215/48; 220/266; 220/275; 222/541.5; 383/904; 383/906

(58) Field of Classification Search ..... 215/48, 215/253; 220/266, 276; 222/541.5; 383/904, 383/906

See application file for complete search history.

(56) References Cited

U.S. PATENT DOCUMENTS

| | | | | |
|---|---|---|---|---|
| 4,408,700 | A | 10/1983 | Fillmore et al. | |
| 5,104,008 | A * | 4/1992 | Crisci | 222/153.07 |
| 5,911,340 | A * | 6/1999 | Uematsu | 222/92 |
| 6,382,438 | B1 | 5/2002 | Schneider et al. | |
| 2003/0034323 | A1 * | 2/2003 | Smith et al. | 215/235 |

FOREIGN PATENT DOCUMENTS

| | | | |
|---|---|---|---|
| DE | 1 479 365 | A | 6/1969 |
| EP | 0 763 482 | A1 | 3/1997 |
| EP | 1 247 749 | A2 | 10/2002 |
| WO | WO 97/01493 | A1 | 1/1997 |

* cited by examiner

*Primary Examiner*—Anthony Stashick
*Assistant Examiner*—Elizabeth Volz
(74) *Attorney, Agent, or Firm*—Sughrue Mion, PLLC

(57) ABSTRACT

The invention relates to a closure device (100; 200; 300), for fitting to an opening (41) of a fluid product reservoir (4), said device being embodied in a monobloc form by injection/molding of plastic material and comprising a fixing body (110; 210; 310) for cooperation with the opening on the reservoir to produce a sealed fixing, a distribution duct (120; 220; 320), forming an outlet passage (121; 221; 321) for the fluid product contained within the reservoir, said duct forming a distribution opening (122; 222; 322), a closing body (13; 23; 33), for sealing said duct, said closing body being connected to the distribution duct (120; 220; 320) by means of at least one link of material (132; 232; 332), designed to break on the first withdrawal of the closing body. The invention is characterized in that said closing body (130; 23; 33) comprises a sealing part (131; 231; 234; 331; 334), said sealing part, before sealing, leaves the distribution opening free and, after sealing, closes the distribution opening (122; 222; 322) in a sealed manner.

18 Claims, 8 Drawing Sheets

CLOSURE DEVICE FOR A FLUID PRODUCT RESERVOIR

Figure 1A:
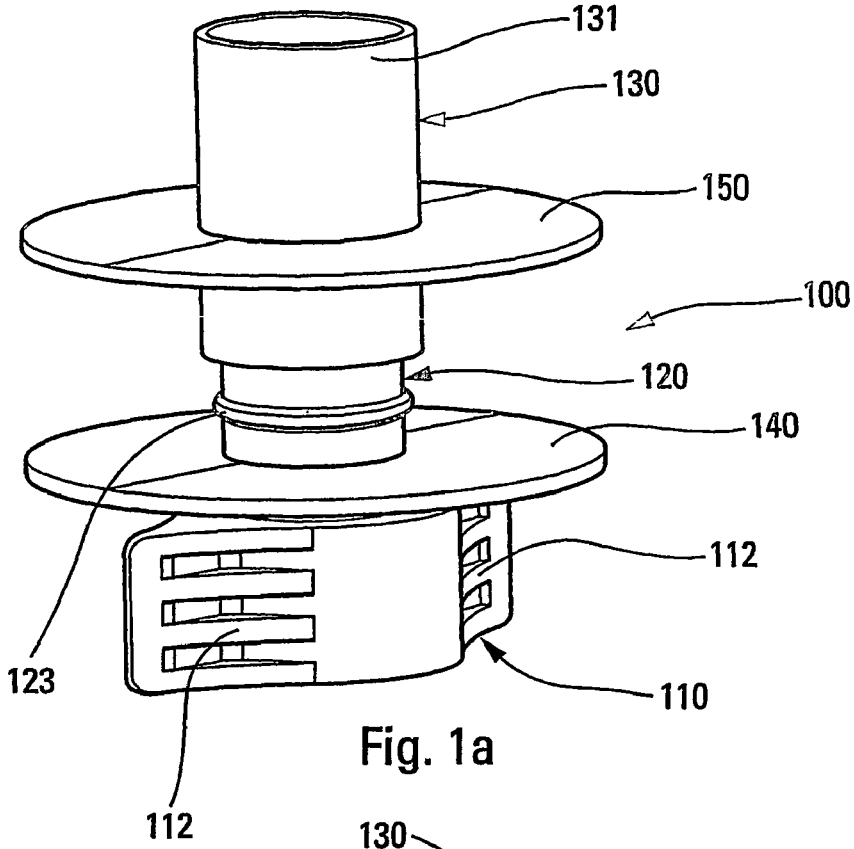

The present invention relates to a closure device intended to be mounted on the opening of a reservoir for a fluid product. The closure device acts as a stopper for the reservoir but must also enable dispensing of the fluid product contained within the reservoir. This type of closure device is frequently used for the packaging of liquid or powdery products.

The closure device may be in the form of an end-piece comprising a part which can be fixed to the reservoir opening and a removable or movable part able to clear an outlet passage to allow dispensing of the fluid product contained in the reservoir. The closure device therefore also allows selective dispensing of the fluid product.

Reservoirs have long been known in bottle form to contain water, beverages or more generally fluid products. The bottle body may be made of plastic or a complex film forming a flexible pouch or semi-rigid carton. The bottle also comprises an end-piece attached to the body of the bottle. This end-piece comprises a duct or neck that optionally carries an outer thread. The end-piece also comprises a screw-cap or press-fit cap which can be forcibly fitted onto the neck.

Closure devices also exist fitted with guarantee or tamper indicating means. When the closure device is in the form of an end-piece comprising a dispensing duct with added cap, the tamper indicating means may be in the form of a band that is integral with the duct and connected to the cap by bridges of frangible material. When the cap is first removed the bridges of material are broken leaving the band integral with the duct. Another tamper indicating means is in the form of a cover, generally heat retractable and surrounding at least part of the cap and part of the duct. Before first use, the user must remove this cover by tearing it off.

The filling of reservoirs fitted with said closure devices may be made in two different ways. One first manner consists of filling the reservoir through the duct formed by the closure device. The cap is then placed on the duct. The cap then forms a part separate from the duct. The second manner consists of filling the reservoir via its bottom end which is initially open. The bottom of the reservoir is then sealed. In this case the cap is initially placed in position on the duct. The closure device may comprise a tamper indicating means. This is not the case with the first filling method since the cap must be placed in position once filling has been completed. An additional tamper indicating means may however still be provided but this requires an additional operation.

Document EP 0 763 482 A1 discloses a closure device comprising a spout and a cap. The spout has a base intended to be fixed to the opening of a package in sealed manner. The cap is joined to the spout by a thin wall which can be broken to separate the cap from said spout. According to this document, the spout, cap and frangible wall may form a monolithic structure. The frangible wall extends circumferentially around the spout forming a junction making the closure device impervious. In addition, snap-on fastening means are provided also guaranteeing the sealing of said closure device. The closure device in this document is made by injection moulding plastic material in which the liquid plastic material is injected under pressure into a mould. The preamble of the main claim is based on this prior art.

The purpose of the present invention is to overcome the said drawbacks of the prior art by defining a closure device with which it is possible to fill the reservoir indifferently either through the closure device or via the bottom end of the reservoir. Another objective of the closure device of the invention is to require a minimum number of parts. A further objective is that the closure device should comprise a tamper indicating means which is advantageously integrated within the closure device to form a single piece.

To attain these objectives the present invention proposes a closure device having the characteristics of the main claim. Advantageously the closing member, said dispensing duct and said at least one bridge of material are monolithically formed. The bridge or bridges of material provide the user with direct visual indication of any prior opening of the closure device.

Advantageously, the sealable part is deformable and can be welded to itself.

According to a first embodiment, the sealable part may be pinched or crushed and then welded. According to another embodiment, the sealable part comprises a fixed element connected to the duct by said at least one bridge of material and a sealing cap intended to be fixed irremovably onto the fixed element, said cap closing and sealing the dispensing orifice. Advantageously, the cap is joined articulated fashion to the fixed element. The articulation between the cap and the fixed element forms a deformable part. Preferably, the cap and the fixed element are formed monolithically.

Although final, advantageously impervious, fixing of the cap onto the fixed element may be obtained by mere mechanical engagement, it is advantageous to weld the cap onto the fixed element.

According to a further characteristic, the cap forms a sealing bush intended to come into sealed contact with the duct to close it imperviously. This sealing bush is used to form a seal before and/or after the first removal of the closing member.

According to a further characteristic the bridge of material extends continuously around a duct, also forming a sealed junction between the duct and the closing member. In this case, a sealing bush is not necessary.

In one practical embodiment, the closure device comprises a peripheral sleeve connected at one end to the outside of the duct by said at least one bridge of material, said sleeve comprising an opposite peripheral end forming the sealable part. The sleeve may form or consist of the fixed element.

According to a further characteristic of the invention, the duct and the closing member are provided with snap-fit means intended to cooperate after the breakage of said at least one bridge of material. Therefore the closing member may be held fixedly onto the duct after its first removal. Advantageously the snap-fit means form sealing means closing the duct.

According to another aspect, the fixing member comprises a fixing appendage on which it is intended to secure the opening of a flexible pouch, advantageously by welding. The closure device of the invention finds priority application when associated with a flexible pouch which advantageously has a characteristic of being freely deformable. However other reservoirs such as cartons may also be used. Rigid reservoirs are not excluded.

Preferably, the closure device is formed as a single piece by the injection moulding of plastic material.

The invention will now be described more amply with reference to the appended drawings giving non-limitative illustrations of three embodiments of the invention.

Figure 1C:
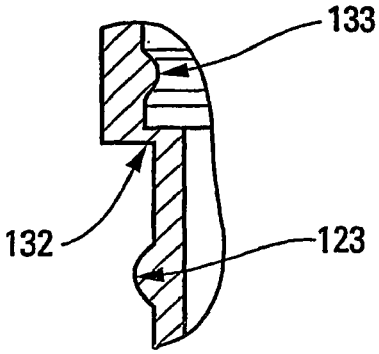
Figure 1B:
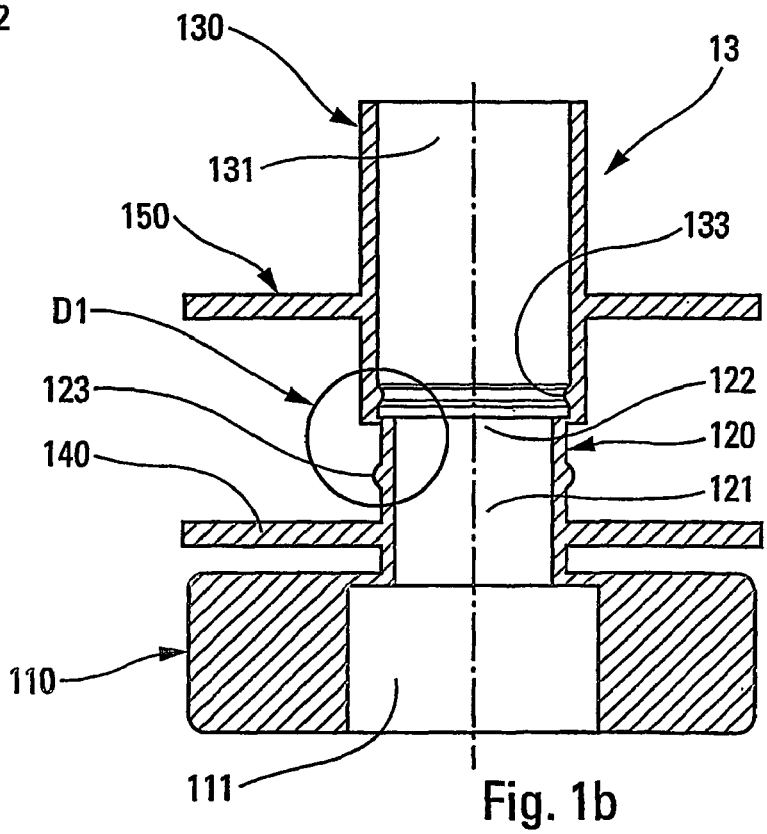
Figure 1D:
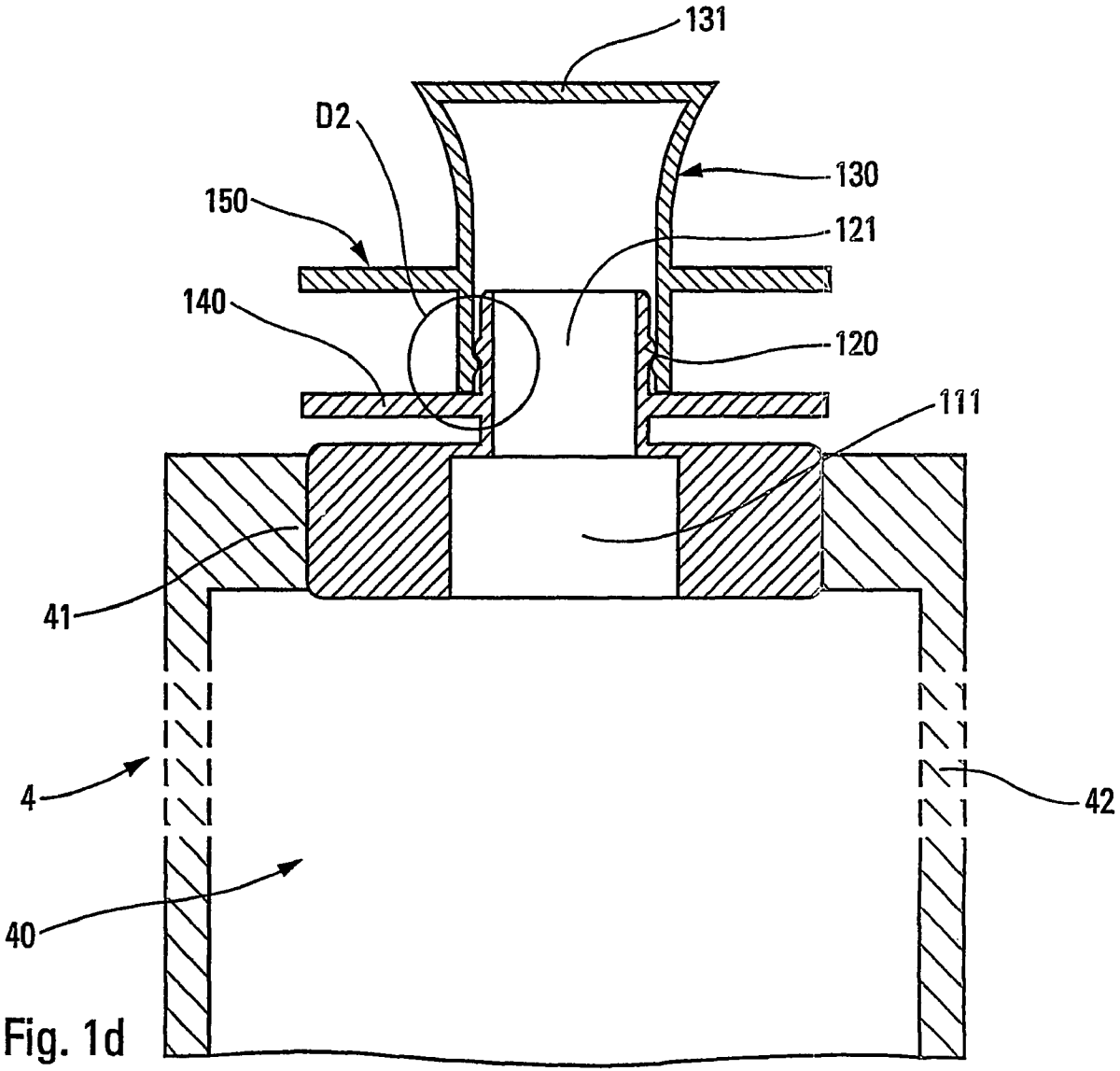
Figure 1E:
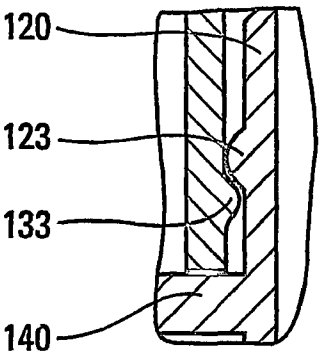
Figure 2A:
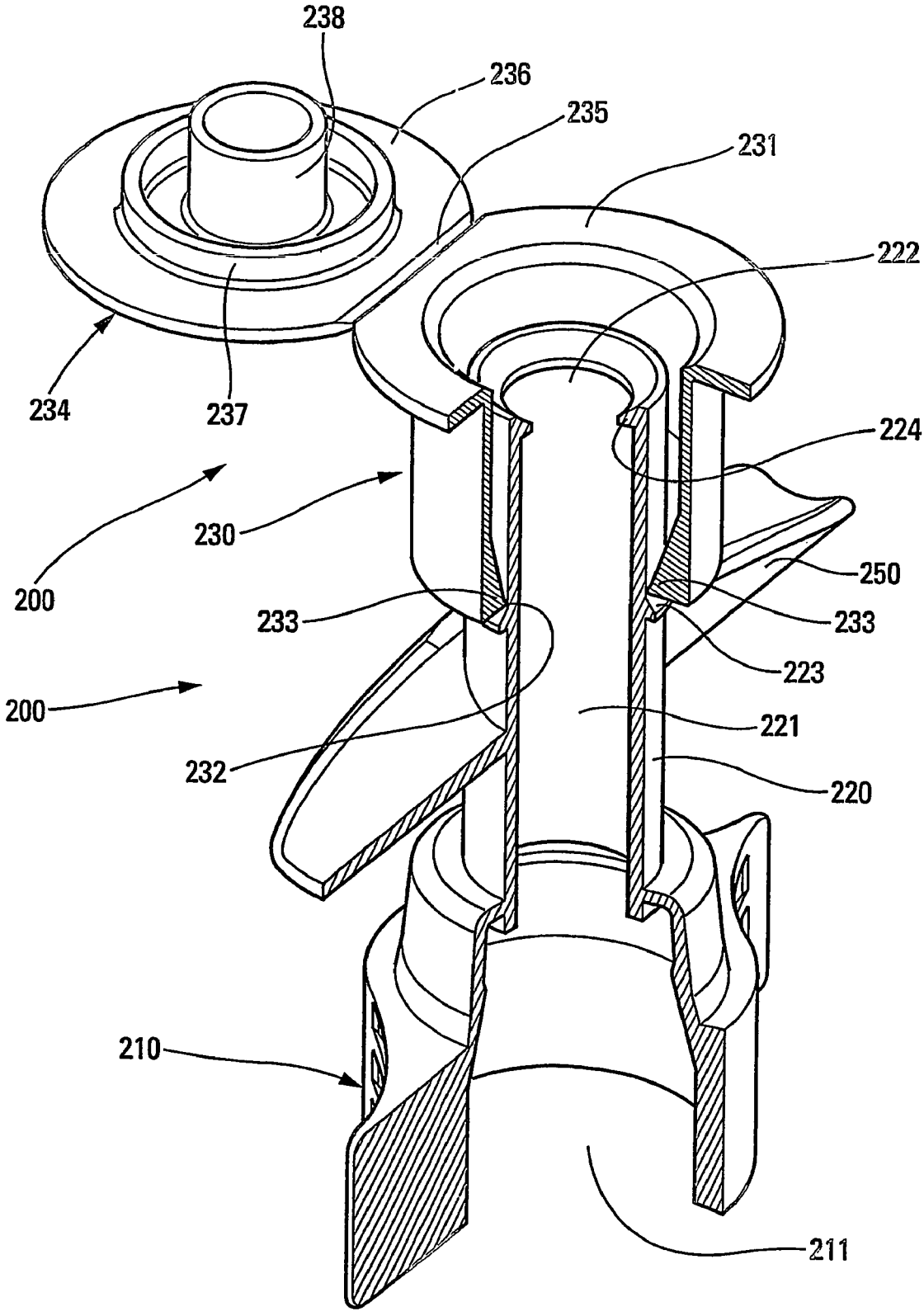
Figure 2B:
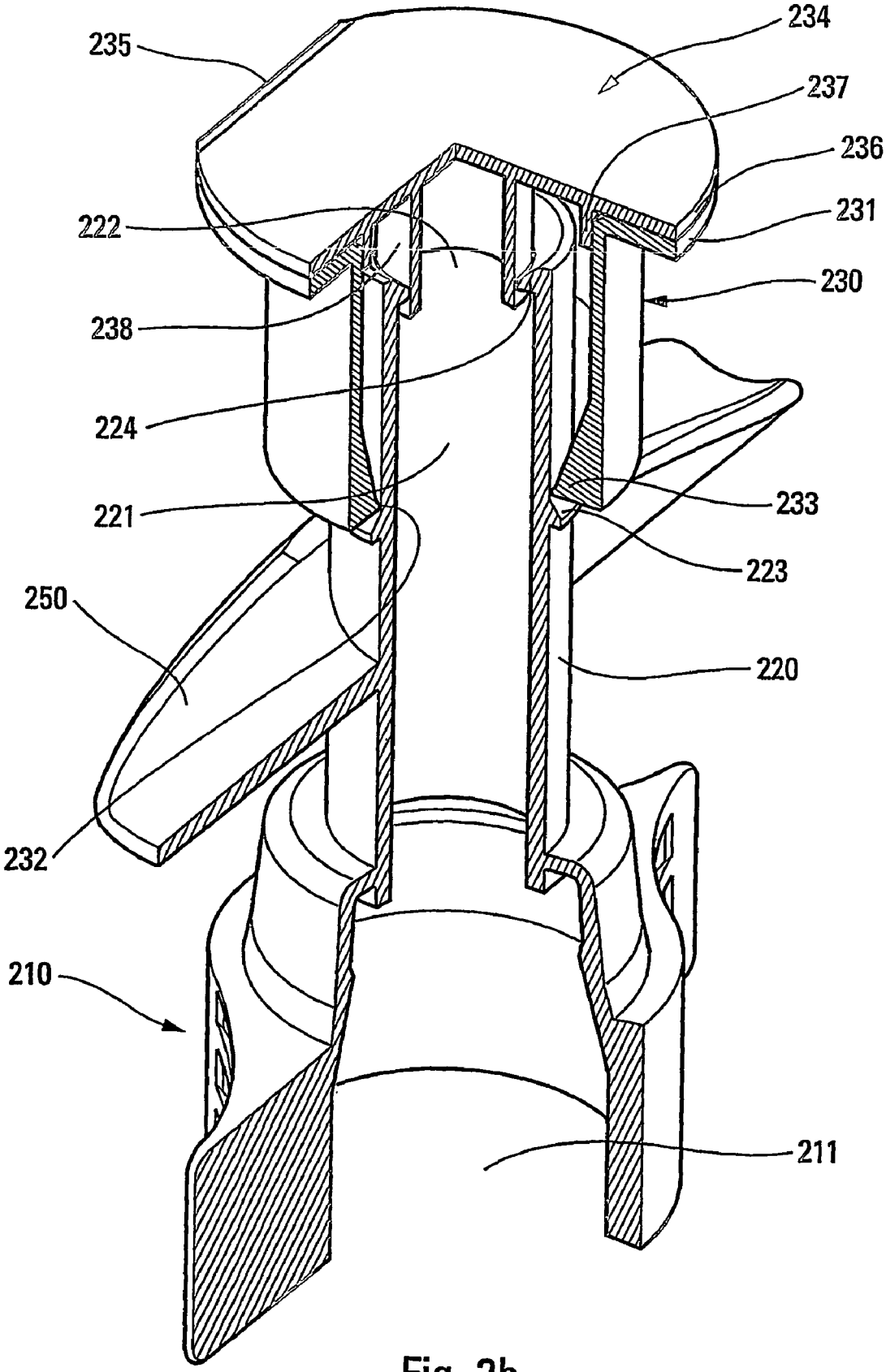
Figure 2C:
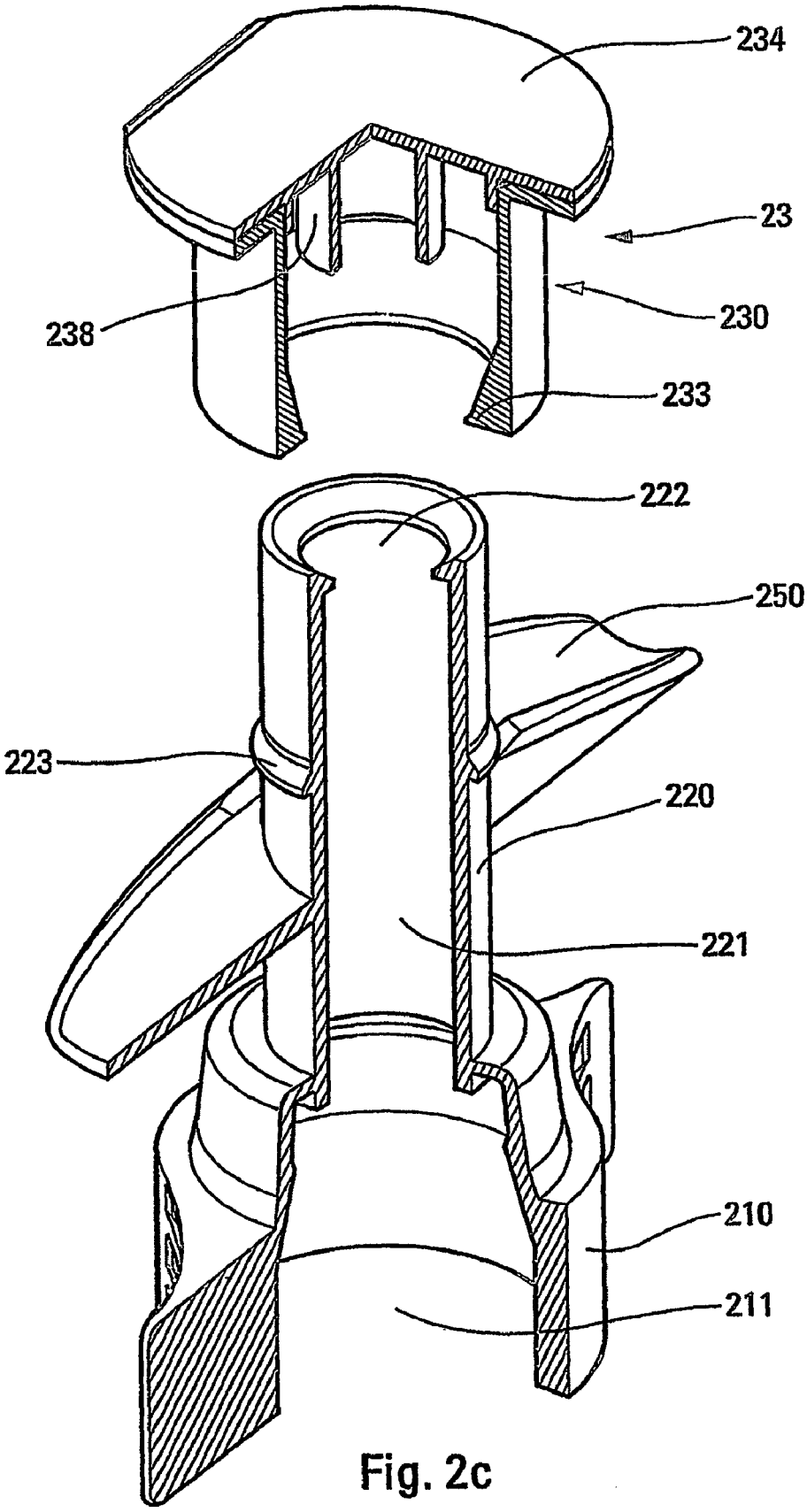
Figure 2D:
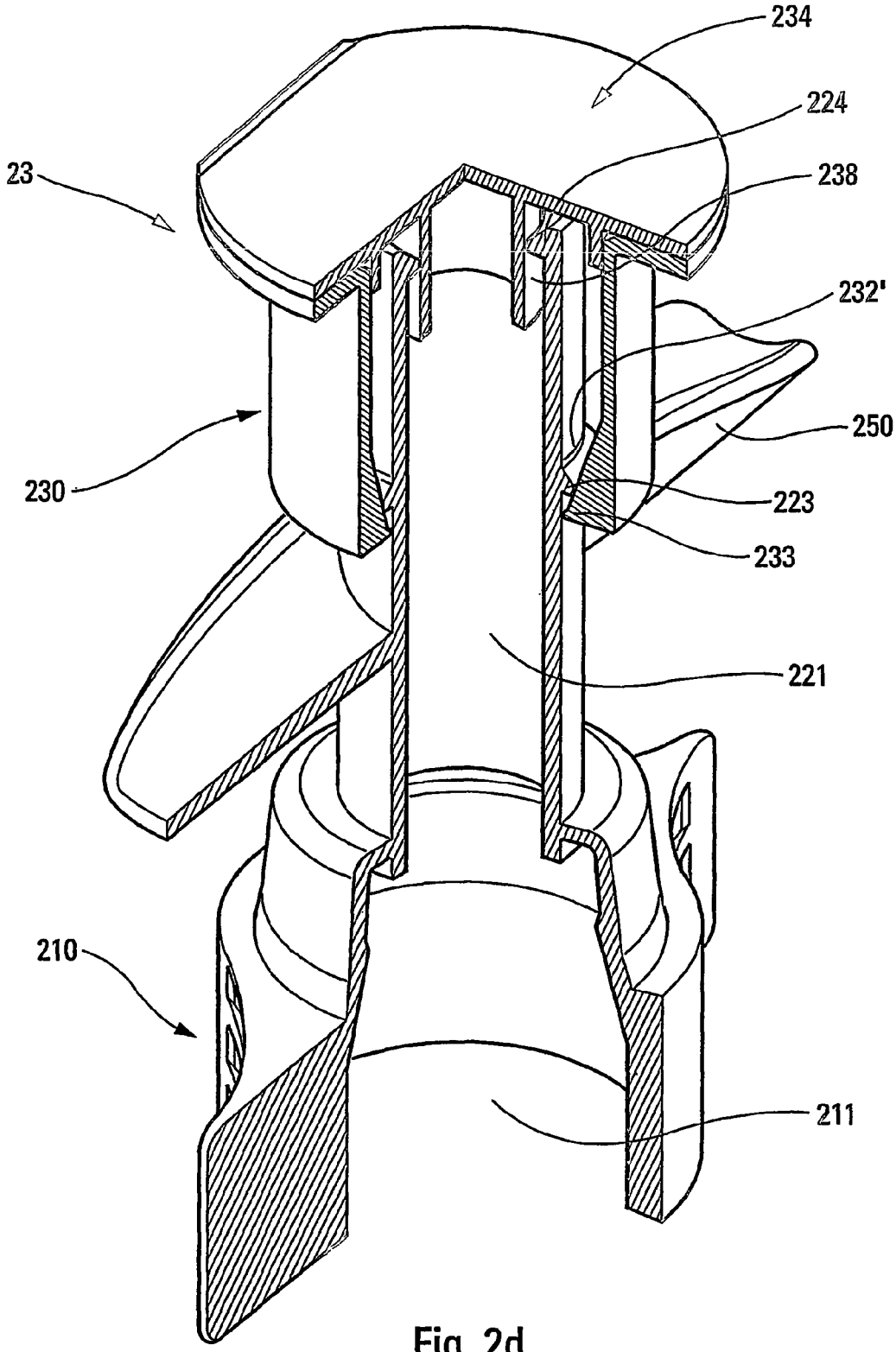

In the figures:

FIG. 1*a* is perspective view of a closure device according to a first embodiment of the invention, FIG. 1*b* is a vertical cross-sectional view through the closure device in FIG. 1*a*, FIG. 1*c* is an enlarged view of detail D1 in FIG. 1*b*, FIG. 1*d* is a vertical cross-sectional view through the device in the preceding figures associated with a flexible pouch after its first use, FIG. 1*e* is an enlarged view of detail D2 in FIG. 1*d*, FIGS. 2*a*, 2*b*, 2*c*, 2*d* are part cut-away perspective views of a closure device according to a second embodiment of the invention on mould release, when sealed, opened and re-closed.

Figure 3A:
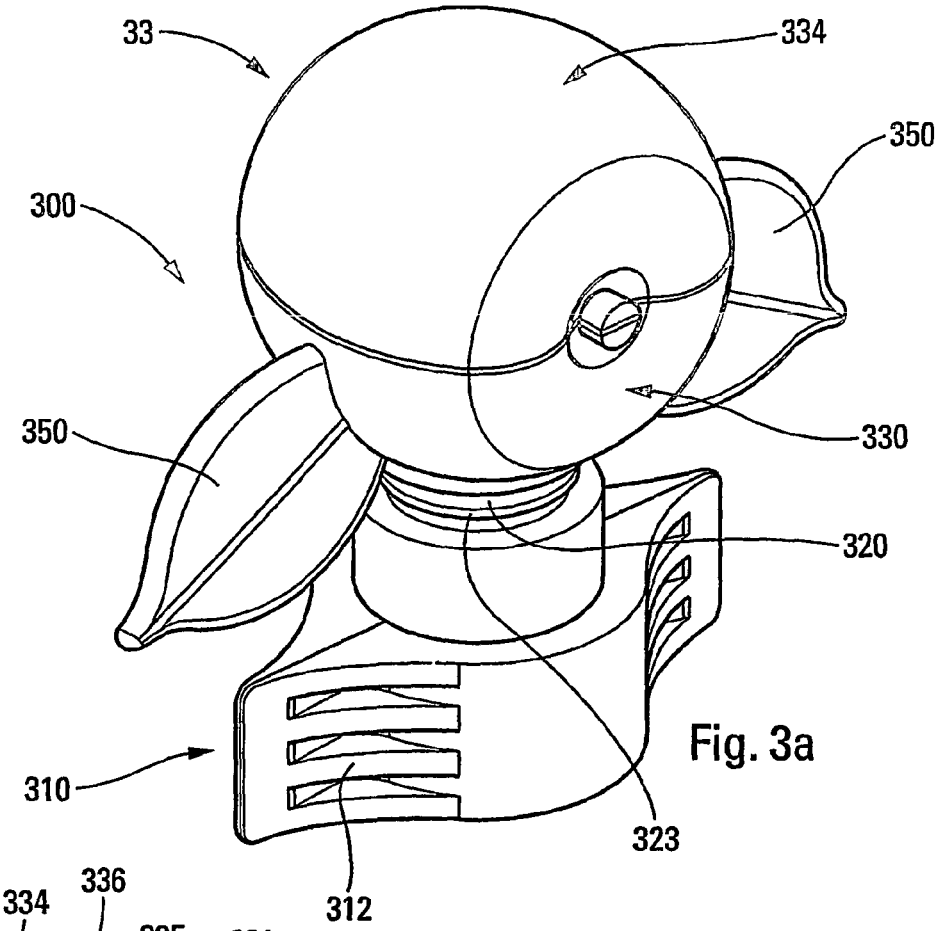
Figure 3C:
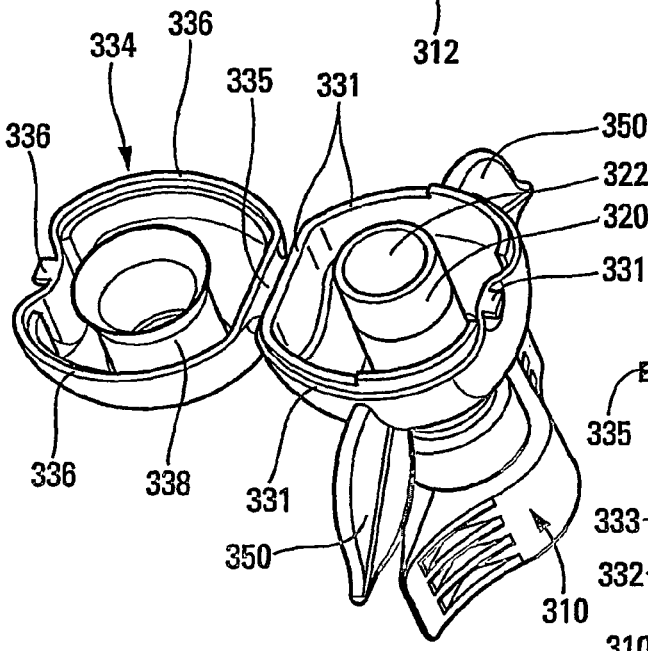
Figure 3B:
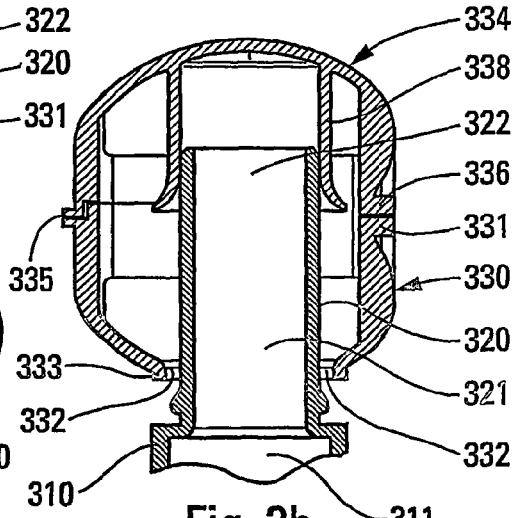
Figure 3F:
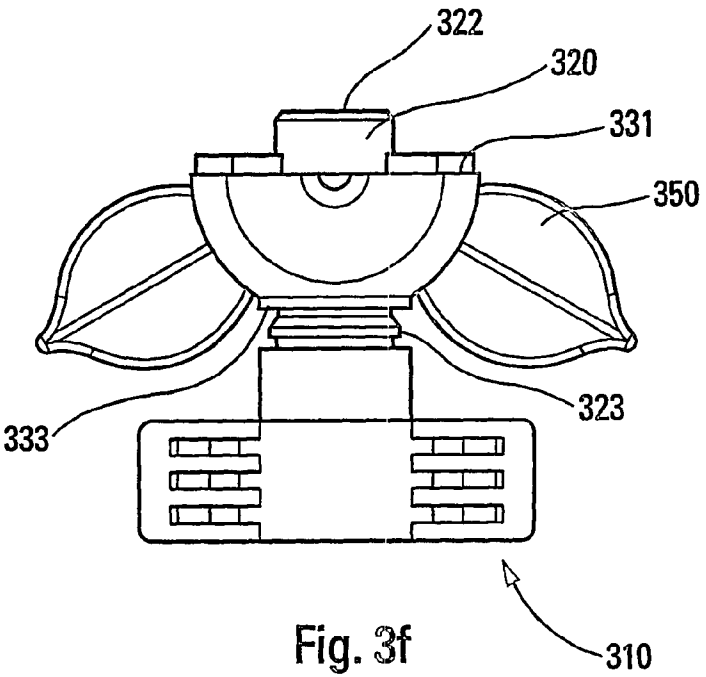
Figure 3D:
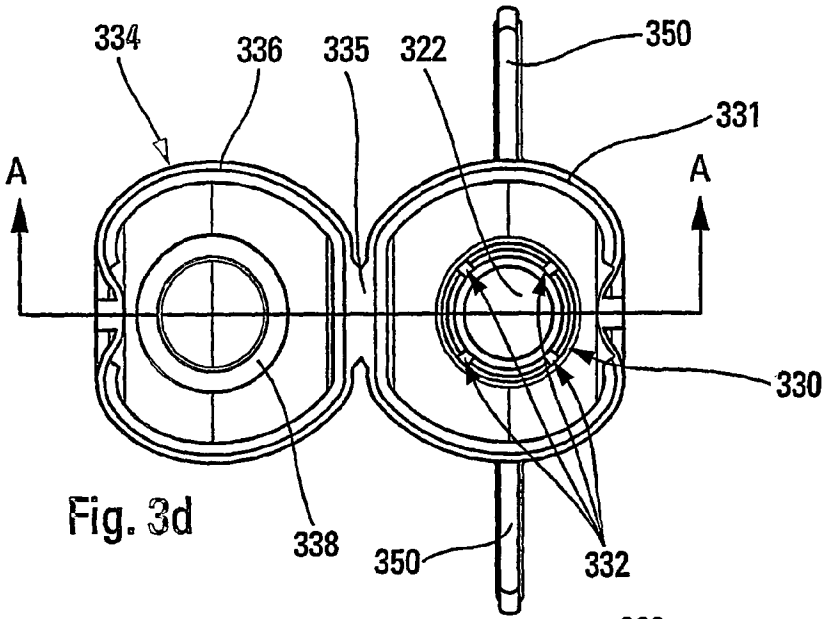
Figure 3E:
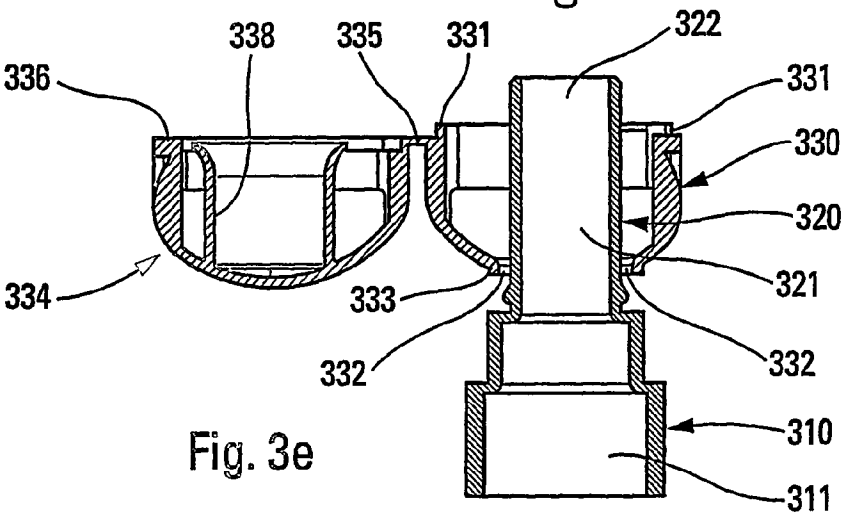

FIG. 3*a* is a perspective view of a closure device according to a third embodiment of the invention, FIG. 3*b* is a vertical cross-sectional view through the device in FIG. 3*a*, FIG. 3*c* is a perspective view of the device in FIG. 3*a* before sealing, FIG. 3*d* is an overhead view of the dispenser in FIG. 3*c*, FIG. 3*e* is a vertical cross-sectional view though the dispenser in 3*c*, FIG. 3*f* is a side view of the dispenser in FIG. 3*c*.

In the three embodiments of the invention, the parts, elements, members, zones or areas fulfilling identical functions are denoted with numerical references comprising the same tenth root but differing in their hundredth digit. Therefore the first embodiment comprises numerical references for the first hundred, the second embodiment comprises numerical references with the second hundred and the third embodiment carries numerical references with the third hundred. The closure device in the first embodiment is denoted 100, in the second embodiment by numerical reference 200 and in the third embodiment by numerical reference 300.

We refer firstly to FIGS. 1*a*, 1*b*, 1*c*, 1*d* and 1*e* to describe the first embodiment. The closure device 100 shown in full FIGS. 1*a*, 1*b* and 1*d* is preferably made by injecting plastic material into a mould. Preferably the plastic material is relatively rigid. It may however have characteristics of deformability with reduced thicknesses. According to the invention the closure device 100 is made as a single piece. This means that it is made in one same mould.

The closure device 100 comprises a fixing member 110 which comprises a fixing appendage 112 in the form of an eye or lozenge. The outer shape of the fixing appendage 112 however is generally cylindrical. On the inside the fixing member defines an inlet passage 111. As can be seen FIG. 1*d*, a container, which here is in the form of a freely deformable flexible pouch 4, defines an inner volume 40 intended to be filled with fluid product. The flexible pouch 4 comprises an opening 41 which is fixed, advantageously by welding, onto the fixing appendage 112 of the fixing member 110. The flexible pouch 4 may for example be made from a complex film that is folded over and then welded on its side edges 42 and at the opening 41. The use of said flexible pouch 4 in association with the closure device of the invention is of particular advantage but it is not to be considered as limitative or unique. Other types of container may be used in association with the closure device of the invention. The inlet passage 111 formed inside the fixing member 110 communicates directly with the effective inner volume 40 of the flexible pouch 4. Above fixing member 110 the closure device 100 comprises a duct 120 which inwardly defines an outlet passage 121 which communicates upstream with inlet passage 111 and downstream with the outside at a dispensing orifice 122. Duct 120 is provide outwardly with a ring-shaped plateau 140 which extends radially outward from duct 120. This plateau 140 partly or fully overhangs fixing member 110, as can be seen in the figures. On the outside, duct 120 also forms one or more peripheral bosses 123 for snap-fit fastening which project radially outwards. In the case shown in the figures, there is only one continuous boss. This embossment is located above plateau 140. Duct 120 is joined monolithically at its lower end to the fixing member 110 and comprises an opposite upper end which is connected to a sleeve 130 via a bridge of frangible material 132. This bridge of frangible material 132 extends continuously around the upper end of the duct 120 like a collar or band. The continuous bridge 132 joins the sleeve 130 on the inside of the sleeve. This can be seen FIG. 1*b* and more clearly FIG. 1*c* which is an enlarged view of detail D1 in FIG. 1*b*. It can be noted in particular that the outer diameter of the duct 120 at its upper end is smaller than the inner diameter of sleeve 130 at its lower end. The bridge 132 connects the outside of duct 120 to the inside of the sleeve 130. Duct 120, in its part located above the plateau 40, is preferably of circular cylindrical section. This similarly applies to sleeve 130 in its lower part. A little above its lower end the sleeve 130 inwardly forms a snap-fit bead 133 which projects radially inward. The bead here is continuous around the periphery of the sleeve. The inner diameter at the bead 133 is smaller than the outer diameter of the duct 120 at the embossment 123. The sleeve 130 also forms a collar 150 which here acts as means for gripping the sleeve 130. This grip collar 150 is located above the bead 133. Preferably that part of sleeve 130 located below the collar has a substantially circular cylindrical section. The sleeve 130 also extends above the grip collar 150. This upper part of the sleeve 130 defines a sealable part 131 located in the vicinity of its open, upper free end. Sleeve 130 defines an inner passage which connects the outlet passage 121 of duct 120 with the outside. It is therefore possible to fill the container on which the closure device 100 is mounted. The fluid product is able to pass through sleeve 130, duct 120 and fixing member 110 until it reaches the inside of the reservoir. Once the reservoir is filled, the closure device must be sealed. For this purpose, the invention provides that the sealable part 131 of sleeve 130 is designed to be deformable so that the duct 120 can be pinched until its inner wall makes self-contact. This is achieved by crushing the duct 120. When the inner wall of the duct makes self-contact a welding technique is used, for example with ultrasound, to weld the sleeve 130. This is shown FIG. 1*d*. It can be seen that the sealable part 131 forms an impervious closure. To impart this deformability characteristic to the sleeve, it is advantageous that the upper part of the sleeve located above the grip collar 150 should have a reduced wall thickness with respect to the lower part located underneath the grip collar 150. Also, the grip collar 150 promotes the dimensional stability and rigidity of the lower part of the sleeve 130 located below it. When the upper end of the sleeve 130 at its zone 131 is imperviously sealed the content of the reservoir is isolated from the outside. The bridge of material which connects the sleeve to the duct extends continuously around the duct inside the sleeve. There is therefore no outlet passage at the bridge of material.

When the user wishes to use the dispenser equipped with the closure device of the invention, the reservoir 4 is held in one hand and the other hand takes hold of the grip collar 150. A traction force is then exerted or a rotational force on collar 150 which causes the continuous bridge of material 132 connecting sleeve 130 to duct 120 to be broken. The sleeve 130 and its associated grip collar 150 can then be removed from the remainder of the closure device formed of the sleeve 120, plateau 140 and fixing member 110. The dispensing orifice 122 is then cleared so that the fluid product can be dispensed. The sleeve 130 with its collar 150 form a closure member 13 similar to a removable cap.

The bridge of material 132 acts as guarantee or tamper indicating means offering the user direct visual indication of first use of the closure device.

It is to be noted that the closure device of the invention is formed as a single piece by the injection moulding of plastic material, and it allows filling through the closure device and subsequent sealing of the closure device without removing or adding any additional part. Mere welding after pinching the upper end of the sleeve 130 makes it possible to achieve this sealing.

According to the invention, the closing member 13 can be repositioned on the duct 120 once the bridge of material 132 has been broken. The lower part of the sleeve 130 can be engaged around the duct 120 until the bead 133 of sleeve 130 comes into contact with the embossment 123 of the sleeve 120. Additional pressure exerted for example on the grip collar 150 causes the bead 133 to pass below the boss 123 to active snap-fit closure. This can be seen FIG. 1*d* and more clearly FIG. 1*e* which is an enlargement of detail D2 in FIG. 1*d*. The final position is reached when the lower end of the sleeve 130 abuts the plateau 140. Advantageously, this snap-fitting also achieves a seal between the closing member 13 and the duct. The closing member 13 can therefore be removed and repositioned at will. Hence the closing member 13 which initially acts as filling nozzle and as guarantee of first use is then conventionally used as a re-positionable capping member. Once in place as shown FIG. 1*d*, the grip collar 150 and the plateau 140 together define a gripping space intended to receive two fingers of the user, affording easy-carrying of the dispenser formed of reservoir 4 and closure device 100.

In the second embodiment shown FIGS. 2*a*, 2*b*, 2*c* and 2*d* the closure device 200 is also formed as a single piece by the injection of plastic material. It also comprises a fixing member 210 inwardly defining an inlet passage 211, a duct 220 inwardly defining an outlet passage 221 leading to a dispensing orifice 222 and a closing member 23 which cooperates with duct 220. The closing member 23 is preferably formed as a single piece.

Duct 220 is provided with two gripper wings 250 which extend crosswise in diametrically opposite manner from duct 220. Above these two wings 250, the duct 220 outwardly forms a snap-fit embossment 223. At its upper end, the sleeve 220 inwardly forms a sealing lip 224. It can even be said that this lip 224 defines the dispensing orifice 222.

The closing member 23 comprises a sleeve 230 defining a lower end forming a snap-fit bead 233 which subsequently cooperates with the snap-fit embossment 223 of duct 220. Sleeve 230 is joined to duct 220 at the level of bead 233 via a bridge of material 232. This bridge 232 may be continuous extending over the entire periphery of the duct inside the sleeve. As a variant, there may be several bridges of material in the form of discrete junction points. The sleeve 230 extends concentrically around the upper part of duct 220. At its upper end, the sleeve 230 forms a sealable part 231 here in the form of a band 231 which extends radially outwards. The sleeve 230 forms a fixed element made integral with duct 220 via the bridge or bridges of material 232. As in the preceding embodiment, the bridge(s) of material are intended to break or yield so as to separate the sleeve 230 from the duct 220.

The closing member 23 also comprises a cap 234 which is connected to sleeve 230 via an articulation 235. This articulation 235 is formed at the band 231. The articulation 235 therefore connects the cap 234 with the band 231. The cap 234 forms a sealing disc 236 intended to make contact with band 231 around its entire periphery. This is possible since disc 236 is articulated with respect to the band 231 at the articulation 235. On this account the cap 234 is able to pivot with respect to the sleeve 230 so as to close disc 236 down onto the band 231, as shown FIG. 2*b*. The cap 234 preferably forms a skirt 237 intended to house itself inside the sleeve 230. Skirt 237 may for example be forcibly housed inside sleeve 230. It is also possible to provide for final, irremovable fixing means so that cap 234 can no longer be removed from the sleeve 230 once the cap 234 is closed down onto the sleeve 230. The skirt 237 may for example be provided with a harpooning profile intended to bite into the inner wall of sleeve 230. It is also possible to provide for snap-fit means at this level. The fixing of cap 234 onto sleeve 230 advantageously achieves a peripheral seal so that the product cannot leak between the band 231 and the disc 236. According to a preferred embodiment, the cap 234 is welded onto the sleeve 230 at the level of the band 231 and disc 236. It will easily be understood with reference to FIG. 2*b* that peripheral welding may be made at the connecting edges of the band 231 and disc 236. The seal may however be achieved solely by the skirt 237. The cap 234 also forms a sealing bush 238 intended to house itself sealed fashion inside the duct 220 at the sealing lip 224. More precisely, the sealing lip 224 is slightly deformed against the outer wall of the bush 238 as can be seen FIG. 2*b*. Therefore the fluid product cannot leak outside the outlet passage 221 sealed by bush 238.

As in the preceding embodiment, the closing member forms a sealable part which here consists of the band 231 and cap 234. In the position shown FIG. 2*a*, the outlet passage 221 opens towards the outside and it is therefore possible to fill a reservoir connected to the fixing member 210. After filling, the cap can be closed down as previously. It may even be welded. This gives the position shown FIG. 2*b*. When a user wishes to use the dispenser equipped with the closure device 200, one hand may take hold of the reservoir, the duct 220 or the wings 250 and the other hand takes hold of the closing member 23. A rotational or traction force is then used to break the bridge(s) of material 232. The closing member may then be removed from the duct 220. Dispensing of the fluid product then becomes possible via duct 220. The closing member 23 can also be repositioned: it is possible to engage the sleeve 230 around the duct 220 until the bead 233 engages underneath the embossment 223. This is shown FIG. 2*d*. The sealing bush 238 is then fully engaged in lip 224.

In this embodiment, the sealing bush fulfils the functions of a sealable end-piece for filling, a tamper indicating means and a conventional function of re-positionable cap whilst being formed monolithically. Welding is even optional.

Closure device 300 in the third embodiment of the invention has a structure and functioning comparable to that of the second embodiment 200. Closure device 300 also comprises a fixing member 310 forming a fixing appendage 312 inside which an inlet passage 311 extends. A dispensing duct 320 extends above the fixing member 310. Duct 320 forms an outlet passage 321 in the continuation of the inlet passage 311. At its downstream end the outlet passage 321 forms a dispensing orifice 322. The outer wall of the duct 320 also forms a continuous peripheral embossment 323. However, this embossment 323 may also be in the form of several bosses regularly distributed around the periphery of duct 320. The closure device 300 also comprises a closing member 33 which, although of different shape to the one in the second embodiment, integrates functionally identical elements. The closing member 33 comprises a sleeve 330 which extends in substantially concentric manner around the duct 320. The lower end of the sleeve 330 forms a snap-fit bead 333 at whose level the sleeve 330 is joined to the duct 320 via four discrete bridges of material 332. At its opposite upper end the sleeve 330 forms a sealing band 331. The sleeve 330 is joined to a cap 334 via an articulating hinge 335. The cap 334 forms a sealing edge 336 intended make contact with the sealing band 331 of sleeve 330. The cap 334 also forms a sealing bush 338 intended to come into sealed contact with the outside of the upper end of sleeve 320 as can be seen FIG. 3*b*. When the closure device is in the state shown FIG. 3*e,* the dispensing orifice 322 is fully cleared so that it is possible to fill the reservoir connected to the fixing member 310 via duct 320. When the reservoir is filled the cap 334 can be closed down onto the sleeve 330 by pivoting around the articulation hinge 335. The edge 336 then joins with the band 331. To achieve an ensured seal, peripheral welding may be made at the point where the band 331 and edge 336 make contact. The sleeve 330 and the cap 334 then form a single monolithic unit that cannot be dismounted. The closing member 33 is also provided with two gripper wings 350 which extend in diametrically opposite manner. When taking hold of the closing member 33 by its wings 350 and applying a tractional force or preferably a rotation the four bridges of material 332 are broken so that the closing member 33 is separated from duct 320. The closing member can then be removed so as to clear the dispensing orifice 322 to allow dispensing of the fluid product.

As in the two preceding embodiments, the closing member 33 can be repositioned on duct 320. To ensure fixing of the closing member onto the duct, all that is needed is to engage the closing member on the duct until the bead 333 of sleeve 330 comes to house itself below the boss 323 of conduit 320. The seal is ensured in the upper part by bush 338 which comes into sealed contact with the upper end of the duct 320.

In the three embodiments just described, several characteristics in common are found. A first characteristic which in itself can be protected, i.e. independently of the other characteristics, lies in the fact that the closing member 13, 23, 33 is initially connected to the outlet duct 120, 220, 320 by one or more bridges of frangible material 132, 232, 332. A second characteristic, which could also be protected as such, lies in the fact that the closing member 13, 23, 33 comprises a sealable part 131, 231, 331 which makes it possible to close the communication between duct 320 and the outside. A further characteristic lies in the fact that the closing member comprises a deformable part 131, 235, 335. A still further characteristic lies in the fact that the closing member can be repositioned and held in place by snap-fitting.

The invention claimed is:

1. Closure device intended to be mounted on an opening of a fluid product reservoir, said device being formed as a single piece by injection moulding plastic material and comprising:

a fixing member intended to cooperate with the reservoir opening to form a sealed attachment, a dispensing duct forming an outlet passage for the fluid product contained in the reservoir, said duct forming a dispensing orifice, and a closing member to close and seal said duct, said closing member being joined to the dispensing duct by at least one bridge of material intended to be broken when the closing member is first removed, wherein said closing member comprises a sealable part said sealable part, before sealing, leaving the dispensing orifice clear before the first removal of the closing member and, after sealing, closing the dispensing orifice in sealed manner;

wherein the closing member, said dispensing duct and said at least one bridge of material are formed as a single piece.

2. Closure device as in claim 1, wherein the sealable part is deformable and can be welded to itself.

3. Closure device as in claim 1, wherein the fixing member comprises a fixing appendage on which the opening of a flexible pouch is intended to be fixed, advantageously by welding.

4. Closure device as in claim 1, wherein leaving the dispensing orifice clear and closing the dispensing orifice in sealed manner each represents a separate status of the sealing member when the bridge is still intact.

5. Closure device wherein the sealable part provides a structure in which the fluid product reservoir is able to be filled when the closing member is attached to the fluid product reservoir.

6. Closure device as in claim 1, wherein the duct and the closing member are provided with snap-fit means intended to cooperate after the breaking of said at least one bridge of material.

7. Closure device as in claim 6, wherein the snap-fit means form sealing means closing the duct.

8. Closure device as in claim 1, wherein the sealable part comprises a fixed element, connected to the duct by at least one bridge of material, and a sealing cap intended to be fixed irremovably on the fixed element, said cap closing and sealing the dispensing orifice.

9. Closure device as in claim 8, wherein the cap is welded onto the fixed element.

10. Closure device as in claim 8, wherein the cap forms a sealing bush intended to come into sealed contact with the duct for its sealed closing.

11. Closure device as in claim 8, wherein the cap is connected articulated fashion to the fixed element.

12. Closure device as in claim 11, wherein the cap and the fixed element are formed as a single piece.

13. Closure device intended to be mounted on an opening of a fluid product reservoir, said device being formed as a single piece by injection moulding plastic material and comprising:

a fixing member intended to cooperate with the reservoir opening to form a sealed attachment, a dispensing duct forming an outlet passage for the fluid product contained in the reservoir, said duct forming a dispensing orifice, and a closing member to close and seal said duct, said closing member being joined to the dispensing duct by at least one bridge of material intended to be broken when the closing member is first removed, wherein said closing member comprises a sealable part said sealable part, before sealing, leaving the dispensing orifice clear before the first removal of the closing member and, after sealing, closing the dispensing orifice in sealed manner;

wherein the bridge of material extends continuously around the duct also forming a sealed junction between the duct and the closing member.

14. Closure device as in claim 13, wherein the closing member said dispensing duct and said at least one bridge of material are formed as a single piece.

15. Closure device as in claim 13, wherein the closing member comprises a peripheral sleeve connected at one end to the outside of the duct by said at least one bridge of material, said sleeve comprising an opposite peripheral end forming the sealable part.

16. Closure device intended to be mounted on an opening of a fluid product reservoir, said device being formed as a single piece by injection moulding plastic material and comprising:

a fixing member intended to cooperate with the reservoir opening to form a sealed attachment, a dispensing duct forming an outlet passage for the fluid product contained in the reservoir, said duct forming a dispensing orifice, and a closing member to close and seal said duct, said closing member being joined to the dispensing duct by at least one bridge of material intended to be broken when the closing member is first removed, wherein said closing member comprises a sealable part said sealable part, before sealing, leaving the dispensing orifice clear before the first removal of the closing member and, after sealing, closing the dispensing orifice in sealed manner;

wherein the closing member comprises a peripheral sleeve connected at one end to the outside of the duct by said at least one bridge of material, said sleeve comprising an opposite peripheral end forming the sealable part.

17. Closure device as in claim 16, wherein the closing member, said dispensing duct and said at least one bridge of material are formed as a single piece.

18. Closure device as in claim 16, wherein the bridge of material extends continuously around the duct also forming a sealed junction between the duct and the closing member.

* * * * *